US010865570B2

(12) United States Patent
Longo et al.

(10) Patent No.: US 10,865,570 B2
(45) Date of Patent: Dec. 15, 2020

(54) ACOUSTIC PANEL WALL MOUNTING

(71) Applicant: Velcro BVBA, Deinze (BE)

(72) Inventors: Fabio Billa Longo, Barcelona (ES); Daniel Alejandro Moreno Serrano, Barcelona (ES); Garry Lee Herrington, Wootton Northants (GB); Antoli Fauria Torrent, Mataro (ES)

(73) Assignee: Velcro BVBA, Deinze (BE)

( * ) Notice: Subject to any disclaimer, the term of this patent is extended or adjusted under 35 U.S.C. 154(b) by 0 days.

(21) Appl. No.: 16/714,970

(22) Filed: Dec. 16, 2019

(65) Prior Publication Data

US 2020/0115909 A1 Apr. 16, 2020

Related U.S. Application Data

(62) Division of application No. 16/053,325, filed on Aug. 2, 2018, now Pat. No. 10,550,580.

(51) Int. Cl.

| | |
|---|---|
| ***E04F 13/08*** | (2006.01) |
| ***E04B 1/86*** | (2006.01) |
| *E04B 1/82* | (2006.01) |

(52) U.S. Cl.

CPC ..... *E04F 13/0835* (2013.01); *E04B 1/86* (2013.01); *E04B 2001/8263* (2013.01)

(58) Field of Classification Search

CPC ..... E04F 13/0835; E04F 13/0851; E04F 13/0832; E04F 13/0885; E04F 13/0882;

(Continued)

(56) References Cited

U.S. PATENT DOCUMENTS 1,971,396 A * 8/1934 De Walde ..... F16B 13/00 248/205.3
2,100,635 A * 11/1937 De Vries ..... E04F 13/0835 24/621

(Continued)

FOREIGN PATENT DOCUMENTS

DE 102016009614 2/2018
WO WO 2016/148992 9/2016

OTHER PUBLICATIONS

PCT International Search Report and Written Opinion in International Appln. No. PCT/EP2019/070772, dated Oct. 23, 2019, 14 pages.

(Continued)

*Primary Examiner* — Kyle J. Walraed-Sullivan
(74) *Attorney, Agent, or Firm* — Fish & Richardson P.C.

(57) ABSTRACT

An acoustic panel wall mounting system including a rigid fastening plate and a panel anchor. The rigid fastening plate carries a field of first touch fastening features and defines an aperture for receiving a mechanical fastener to secure the fastening plate against a wall with the field of first touch fastening features exposed. The panel anchor has a helix extending from a rigid surface flange that carries a field of second touch fastening features on a surface opposite the helix. The anchor defines a tool receptacle used for twisting the helix into a panel. The field of first touch fastening features is engageable with the field of second touch fastening features to form a connection when brought into engagement as the panel is placed against the wall to contact the fastening plate with the panel anchor.

10 Claims, 11 Drawing Sheets

(58) Field of Classification Search
CPC ..... E04B 1/86; E04B 2001/8263; Y10T 24/2708; Y10T 24/27
USPC ..... 52/506.05; 24/306, 442
See application file for complete search history.

(56) References Cited

U.S. PATENT DOCUMENTS 4,531,733 A * 7/1985 Hall ..... E04H 12/2269 24/297
4,724,638 A * 2/1988 Bezborodko ..... E04F 13/144 52/311.1
4,899,513 A * 2/1990 Morris ..... E04F 13/0885 248/205.3
5,060,752 A * 10/1991 Heiberger ..... E04B 1/8218 181/200
5,384,939 A * 1/1995 Weber ..... B60N 3/046 24/306
5,537,793 A * 7/1996 Murasaki ..... A44B 18/00 52/585.1
5,691,021 A * 11/1997 Kobe ..... A44B 18/0019 24/442
D390,099 S 2/1998 Bailey et al.
5,980,230 A 11/1999 Dowd et al.
6,059,558 A 5/2000 Buzzell et al.
6,187,247 B1 2/2001 Buzzell et al.
6,224,364 B1 5/2001 Harvey
6,226,844 B1 5/2001 Lerra et al.
6,652,208 B2 * 11/2003 Gillis ..... F16B 5/0208 411/107
7,412,806 B2 * 8/2008 Pacione ..... E04F 15/02 52/311.2
7,963,011 B2 * 6/2011 Lottini ..... E04F 13/088 24/620
8,458,869 B2 * 6/2013 Giannasca ..... F16B 5/0628 24/686
8,910,350 B2 * 12/2014 Poulakis ..... B60R 13/0206 24/306
9,119,444 B2 * 9/2015 Nirmel ..... A44B 18/0084
9,845,598 B1 * 12/2017 Hsu ..... E04F 13/0862
10,550,580 B1 2/2020 Longo et al.
2008/0099639 A1 * 5/2008 Webster ..... A47B 91/06 248/188.9
2009/0064469 A1 * 3/2009 Dowd ..... A44B 18/0057 24/452
2013/0106037 A1 * 5/2013 Ohashi ..... F16F 15/023 267/103
2017/0175896 A1 * 6/2017 Cornu ..... F16J 15/04
2019/0112819 A1 * 4/2019 Gebhardt ..... E04F 13/0885
2019/0257079 A1 * 8/2019 Smith ..... E04B 1/86
2019/0270275 A1 * 9/2019 Chang ..... B32B 7/06
2020/0040588 A1 2/2020 Longo et al.

OTHER PUBLICATIONS

Rotofast.com [online], "Rotofast™ Cloud Anchor," retrieved on May 14, 2020, retrieved from URL <https://rotofast.com/cloud-anchor/>, 1 page.

* cited by examiner

ACOUSTIC PANEL WALL MOUNTING

TECHNICAL FIELD

This invention relates to panel mounting, and more particularly to fasteners and methods for mounting acoustic panels on walls.

BACKGROUND

Mounting acoustic panels to a wall can require much precision and can often be time-consuming. Some systems for mounting acoustic panels require the use of marking methods or additional tools that make the aligning and mounting of panels difficult. Improvements to the methods and systems for mounting acoustic panels are sought.

SUMMARY

One aspect of the invention features an acoustic panel wall mounting system. The mounting system includes a rigid fastening plate carrying a field of first touch fastening features on one broad surface of the plate. The fastening plate defines an aperture for receiving a mechanical fastener to secure the fastening plate to a wall with the field of first touch fastening features exposed. The mounting system also includes a panel anchor that has a helix extending from a rigid surface flange. The flange caries a field of second touch fastening features on a surface opposite the helix. The anchor defines a tool receptacle configured to receive a tool for twisting the helix into a panel until the flange is at an outer surface of the panel with the field of second touch fastening features exposed. The field of first touch fastening features is engageable with the field of second touch fastening features to form a connection when brought into engagement as the panel is placed against the wall to contact the fastening plate with the panel anchor.

In some examples, the tool receptacle has a recess configured to receive or accommodate, when the connection is formed, a head of the mechanical fastener. Such recess allows the connection to be formed with the flange held parallel to the fastening plate.

In some embodiments, the helix includes a hollow cylinder having an external thread. In some cases, the external thread has a varying pitch or a varying lead angle. In some cases, the varying pitch includes an introduction stage thread pitch, a transition stage thread pitch, and a fine-turning stage thread pitch.

In some arrangements, the field of second touch fastening features includes a hook fastening patch permanently affixed to the flange.

In some embodiments, the field of second touch fastening features includes discrete hooks molded directly on the surface of the flange.

In many embodiments, the rigid plate includes a die-cut plate from extruded PVC.

In some examples, one of the field of first touch fastening features and the field of second touch fastening features includes an engageable fibrous surface, and the other of the field of first touch fastening features and the field of second touch fastening features includes a field of discrete hooks configured to engage the engageable fibrous surface. In some cases, the engageable fibrous surface includes a non-woven material. In some cases, the hooks have discrete resin stems extending from a common layer of resin.

In some arrangements, the field of first touch fastening features and the field of second touch fastening features include complementary arrays of hooks that engage when pressed together.

Another aspect of the invention features a method of mounting an object to a mounting surface. The method includes providing a bounded field of discrete touch fastening hooks carried on a surface of the object, and adhering a first adhesive surface of a flexible patch to the field of discrete touch fastening hooks. A release liner is removed from the flexible patch to expose a second adhesive surface opposite the field of fastening hooks. The object is pressed against the mounting surface in a desired position to adhere the second adhesive surface to the mounting surface. The object is moved away from the mounting surface, leaving the flexible patch adhered to the mounting surface with the first adhesive surface exposed. A fastener patch is positioned on the mounting surface over the adhered flexible patch, with the fastener patch carrying a field of fastening loops on a surface opposite the mounting surface. The method further includes attaching the fastener patch to the mounting surface, and then positioning the object in its desired position on the mounting surface and engaging the touch fastening hooks with the field of fastening loops of the attached fastener patch, to mount the object to the mounting surface.

In some embodiments, providing the bounded field of touch fastening hooks includes threading an anchor into a surface of the object. In such embodiments, the anchor includes a rigid surface flange carrying the field of touch fastening hooks. In some cases, adhering the first adhesive surface of the flexible patch to the field of discrete touch fastening hooks includes aligning a central hole of the flexible patch with a tool receptacle of the anchor.

In some examples, the method also includes, prior to adhering the first adhesive surface of the flexible patch to the field of discrete touch fastening hooks, removing a release liner from the flexible patch to expose the first adhesive surface.

In some arrangements, the flexible patch includes a double-sided adhesive sticker.

In some examples, the fastener patch includes a rigid plate carrying the field of fastening loops on one broad surface of the rigid plate.

In most examples, attaching the fastener patch to the mounting surface includes threading a mechanical fastener extending through an aperture of the fastening patch into the mounting surface.

In some cases, positioning the fastener patch on the mounting surface includes aligning a central hole of the fastener patch to a central hole of the flexible patch.

The present invention provides flexibility when aligning and mounting an acoustic panel to a wall in a desired position. The mounting system described herein may form a strong touch fastening connection even when just a portion of the hooks is engaged with a portion of the loops. Such feature allows a user to mount the panel in different positions to align the panel in the desired position. Additionally, the present disclosure describes a method of marking the mounting wall that can be used in different surfaces such as in wood, drywall, masonry, or concrete walls.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
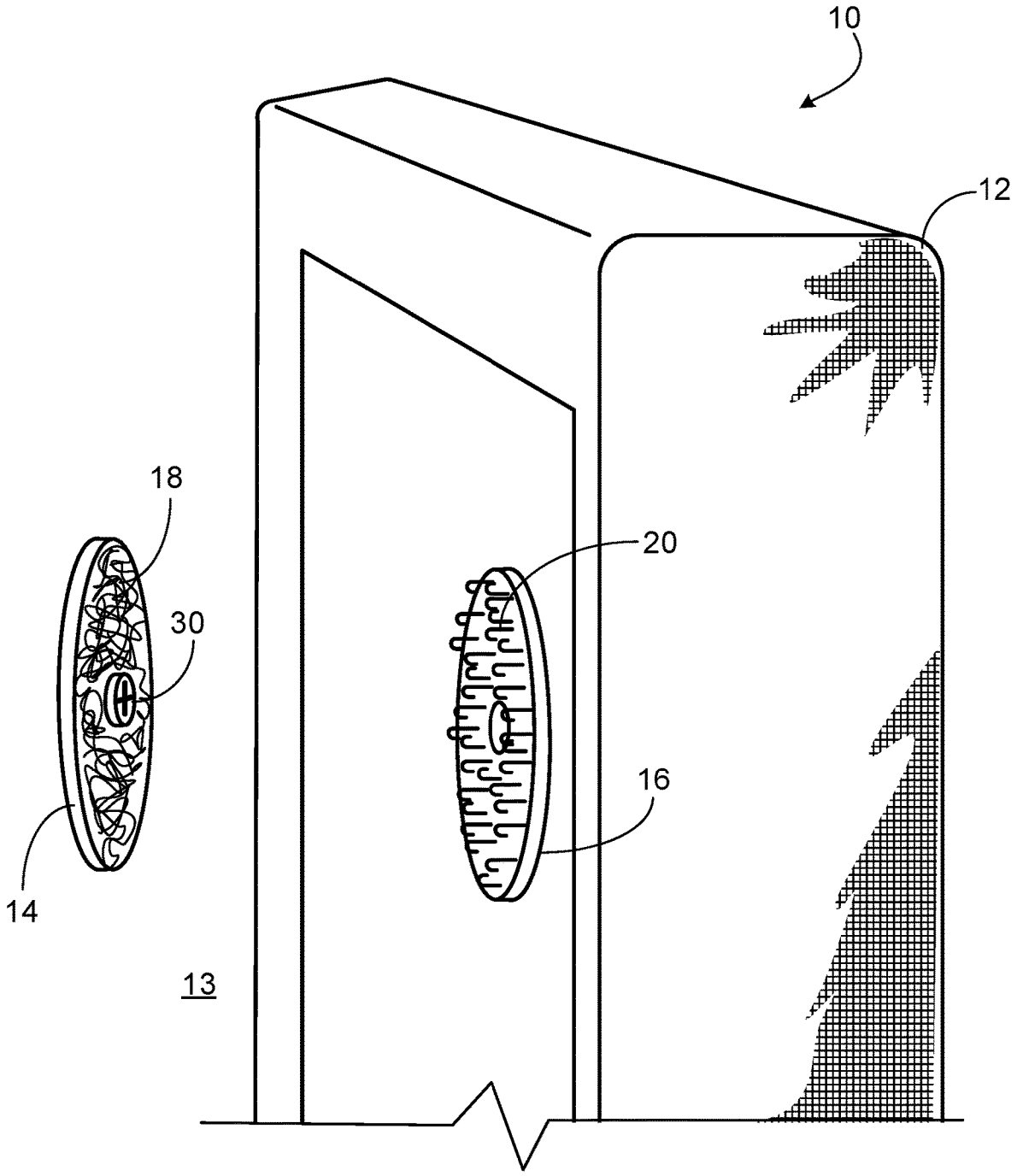
FIG. 1 is a perspective view of an acoustic panel being mounted to a wall using an acoustic panel wall mounting system.

Referring to FIG. 1, an acoustic panel wall mounting system 10 includes a rigid fastening plate 14 secured to a wall and a panel anchor 16 threaded into an acoustic panel 12. Fastening plate 14 carries a field of touch fastening features 18 and panel anchor 16 carries a corresponding field of touch fastening features 20 to form a connection with fastening plate 14. Acoustic panels or sound absorbing panels can help control reverberation and provide sound insulation in rooms. There are many different types and shapes of acoustic panels. Acoustic panels can be installed permanently or temporarily on a wall, ceiling, or similar surface. Some systems for mounting acoustic panels include hooks, clips, and other types of mechanical fasteners. Such systems may require additional tools or exact precision to align the acoustic panels in a desired position. The present invention aims to provide a system for quickly mounting different types of acoustic panels permanently or temporarily, and to provide flexibility at the time of mounting the panel in a desired position.

Fastening plate 14 carries a field of first touch fastening features 18 on one broad surface of the plate. In this example, the touch fastening features 18 of plate 14 are fibrous loops such as non-woven loops, and the touch fastening features 20 of anchor 16 are discrete hooks that engage fastening loops 18. The hooks could be of any shape designed to releasably engage fibers of the mating plate, such as J-shape, palm-tree or mushroom-type hooks. In some examples (not shown), both of the field of first touch fastening features 18 and the field of second touch fastening features 20 are complementary arrays of fastening hooks that form a hook-to-hook connection. A hook-to-hook connection can be a touch fastening connection or it can be a permanent or semi-permanent connection (e.g., configured to engage when pressed together). Plate 14 is secured to a wall 13 by a mechanical fastener 30 extending through an aperture (not shown) of the fastening plate. Panel anchor 16 is threaded into acoustic panel 12 with hooks 20 facing the loops 18 of plate 14. Acoustic panel 12 is mounted to wall 13 by pressing the panel 12 against wall 13 to engage the corresponding fastening features 20 of anchor 16 with the fastening features 18 of rigid plate 14.

Mounting system 10 forms a connection between anchor 16 and plate 14 that is strong enough to retain acoustic panels permanently or temporarily on a wall. Acoustic panels 12 come in different sizes and weight. For example, panel 12 can have a thickness of 25, 40, or 50 millimeters with a weight of 3.25, 4, or 5 kilograms per square meter respectively. Some acoustic panels configured to be installed in a ceiling have a maximum size of about 1.8 square meters. Panel 12 may require around four fasteners 10 per square meter.

Figure 2A:
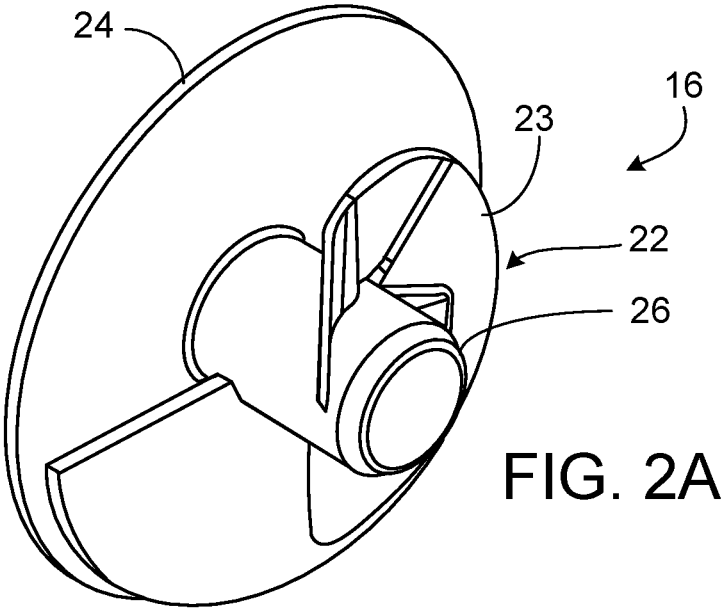
FIG. 2A is a back perspective view of a panel anchor.

Referring to FIG. 2A, panel anchor 16 has a helix 22 that extends from a rigid surface flange 24. Helix 22 includes a hollow cylinder or shaft 26 having an external thread 23. As further discussed in detail below with respect to FIGS. 2B and 2C, thread 23 can have a thread pitch that varies along the thread, to increase the holding strength of the anchor. Panel anchor 16 has a rigid flange 24 from which cylinder 26 extends. Panel anchor 16 can be formed of PVC using injection molding to mold anchor 16 in one piece.

Figure 2B:
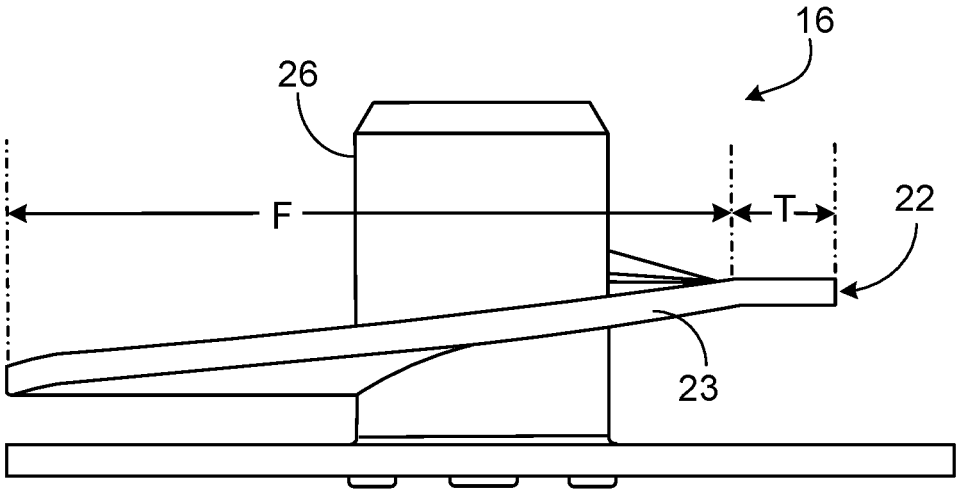
FIG. 2B is a side view of the panel anchor of FIG. 2A, showing a fine-turning stage of a helix.
Figure 2C:
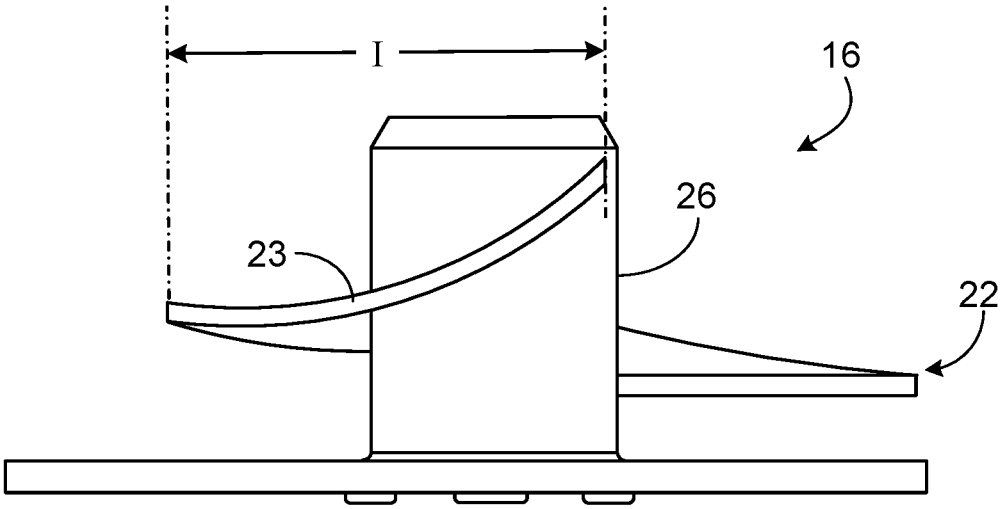
FIG. 2C is a side view of the panel anchor of FIG. 2A, showing an introduction stage of the helix.

FIGS. 2B and 2C show thread 23 of anchor 13 having a thread pitch that gradually increases from the bottom to the top to provide an aggressive entry into the acoustic panel. Helix 22 can be a three-stepped helix or thread (e.g., a helix with three different thread pitches) with the most aggressive thread pitch being at the top of shaft 26, where the helix first enters the acoustic board. As shown in FIG. 2C, thread 23 has an introduction stage 'I' with a large thread pitch or large lead angle to aggressively enter the acoustic board as anchor 16 is twisted. As shown in FIG. 2B, thread 23 has a transition stage 'T' in which the thread pitch is constant. Lastly, thread 23 has a fine-turning stage 'F', in which the thread has a low pitch or low lead angle to increase the holding strength of the anchor.

Figure 3:
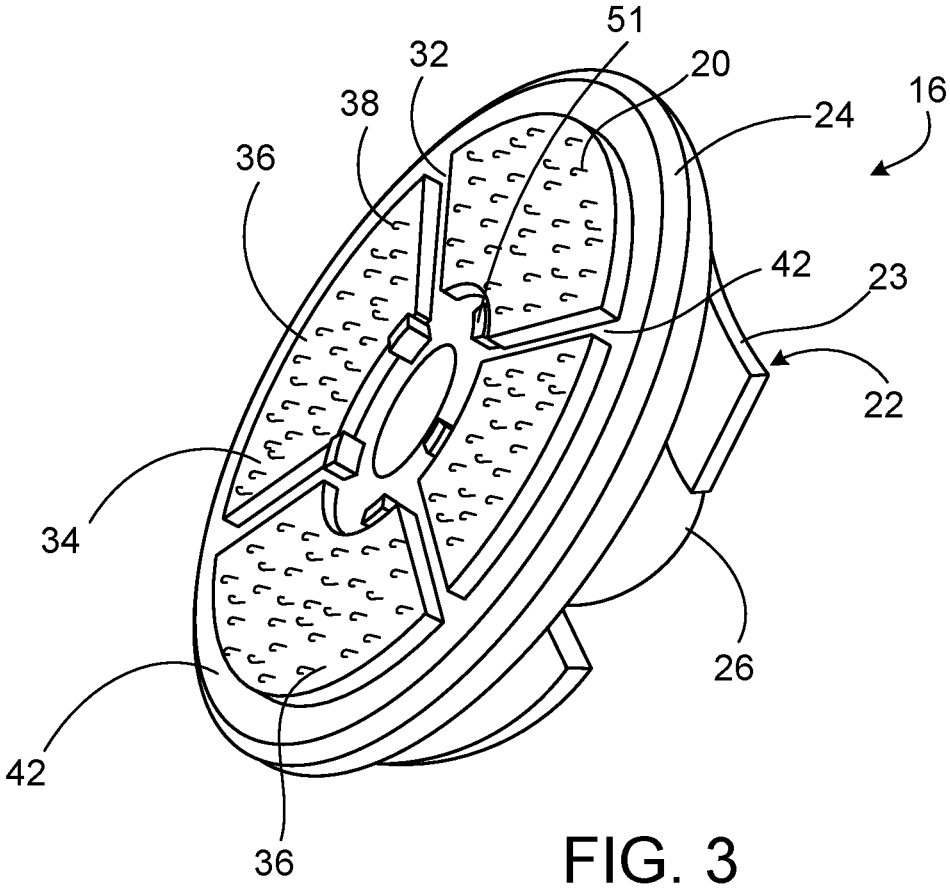
FIG. 3 is a front perspective view of the panel anchor of FIG. 2A.
Figure 4:
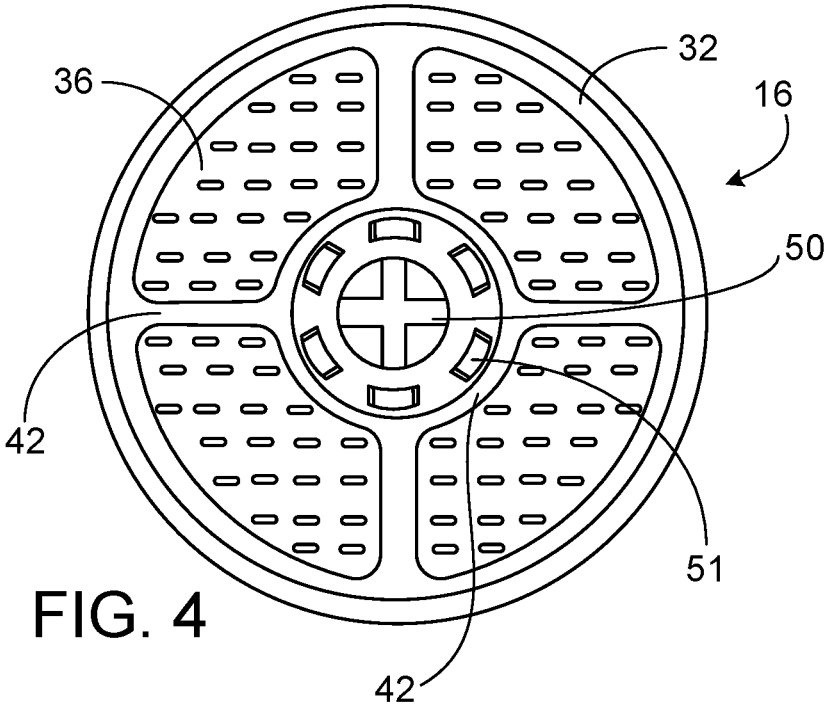
FIG. 4 is a front view of the panel anchor of FIG. 2A.
Figure 5A:
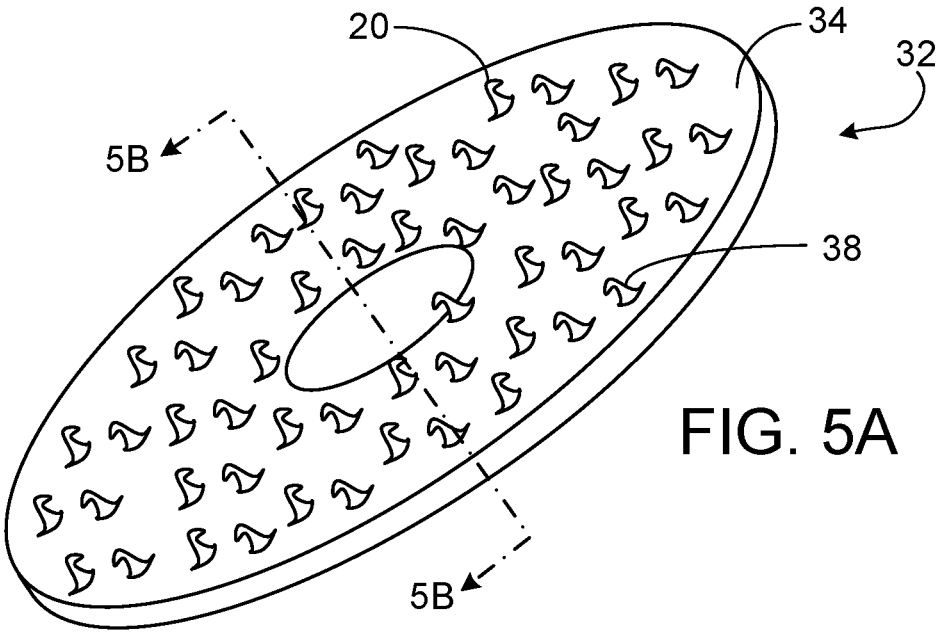
FIG. 5A is a perspective view of a hook fastening patch.
Figure 5B:
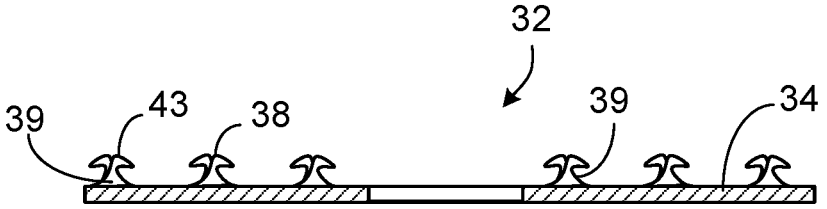
FIG. 5B is a cross-sectional view of the hook fastening patch of FIG. 5A, taken along line 5B-5B in FIG. 5A.

Referring to FIGS. 3-5 panel anchor 16 has a hook fastening patch 32 permanently affixed to a surface of flange 24 opposite helix 22. As shown in FIG. 5A, hook fastening patch 32 includes a ring-shaped resin base 34 having discrete hooks 38 extending from the common layer of resin 34. Referring also to FIG. 5B, hooks 38 have discrete resin stems 39 and a crook portion 43 configured to engage the fibrous loops of a fastening plate. The hooks in this example are illustrated as J-hooks facing in alternate directions, but the hooks could be of any shape such as palm tree or mushroom-type fastener elements. For example, suitable hooks for the temporary mounting of acoustic panels include the HTH848 vinyl white hook available from Velcro USA Inc. Suitable hooks for mounting acoustic panels permanently include the mushroom VEL-LOC® Brand hooks also available from Velcro USA Inc. Base 34 may have a thickness of only about 0.15 millimeters, for example. The hooks 38 and base 34 together can form one contiguous resin mass, with the stem 39 of each hook 38 being integrally molded with and extending from an outer surface of the base. In some examples, such as with woven mushroom hooks, the hooks are woven into the base instead of being integrally molded with the base. Referring to FIGS. 3 and 4, fastening patch 32 is heat welded or bonded to flange 24 to form a permanent bond between patch 32 and anchor 16. Fastening patch 32 can be welded to flange 24 by using ultrasonic welding or other methods for bonding plastic together. Patch 32 may have an adhesive coating (not shown) that is activated with ultrasonic vibrations. As shown in FIG. 3, using ultrasonic welding may include using a sonotrode that contacts thin areas of patch 32 to leave large areas 36 of the patch intact. Areas 36 are islands of resin base 34 carrying fastener hooks 38 bounded by welded areas 42 of patch 32. Welded areas 42 bound every side of islands 36 to permanently secure patch 32 to flange 24.

Flange 24 has aligning tabs 51 that are arranged to center patch 32 in position before welding the patch to the flange. Hook patch 32 can be secured to flange 24 using other methods such as using an adhesive or by using mechanical fasteners (not shown). Alternatively, hooks 38 can be directly molded on the surface of the flange 24 by pressing, for example, flange 24 against a mold roll when the PVC flange is still molten. Hooks 38 can alternatively be integrally formed with flange 24 by using injection molding to form the flange and the hooks together.

Referring to FIG. 4, panel anchor 16 has a tool receptacle 50 configured to receive a tool (e.g., a screwdriver) for twisting or threading the helix of anchor 16 into an acoustic panel. Tool receptacle 50 can have different interface configurations for imparting torque to anchor 16, such as a Phillips head interface, a full bearing surface, or a hexagonal socket interface. The tool interface of anchor 16 can be the same tool interface of the mechanical fastener (shown in FIG. 1) used to attach the rigid fastening plate to a wall. As discussed in more detail below with respect to FIG. 7, tool receptacle 50 includes a recess for receiving a head of the mechanical fastener used to attach the fastening plate.

Figure 6A:
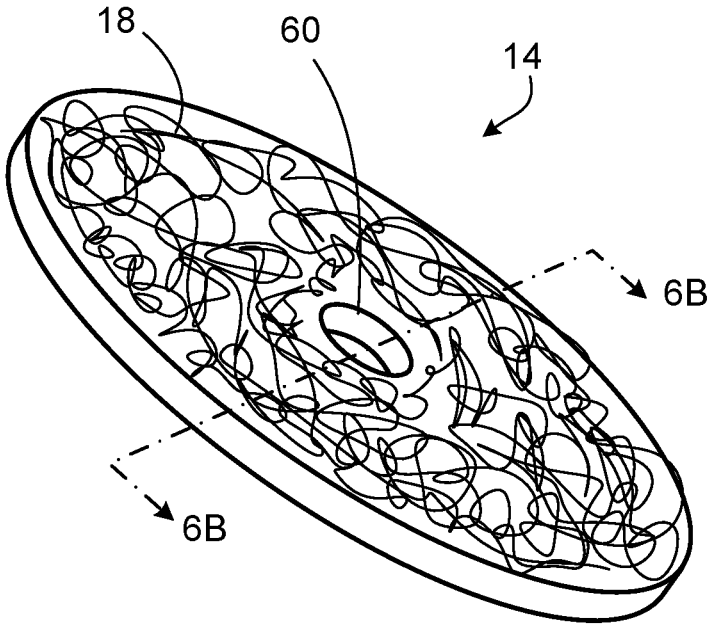
FIG. 6A is a perspective view of a rigid plate carrying a field of fastening loops.
Figure 6B:
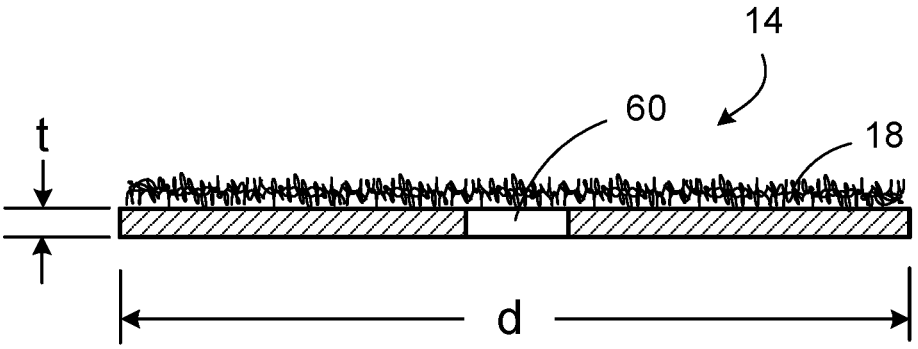
FIG. 6B is a cross-sectional view of the rigid plate of FIG. 6A, taken along line 6B-6B in FIG. 6A.

Referring to FIG. 6A, fastening plate 14 is a thin plate having fastening loops 18 extending from a broad surface thereof. Fastening plate 14 has a small central aperture 60 for receiving a mechanical fastener to attach fastening plate 14 to a wall or a similar mounting surface. Fastening plate 14 can be a PVC plate from an extruded sheet that is die-cut to form plate 14. Fastening plate 14 can alternatively be a flexible patch made of a resin such as silicone, for example. Fibrous loops 18 can be laminated to the PVC sheet when the sheet is still molten. Alternatively, fibrous loops 18 can be laminated to a film, such as a 30-micron polyethylene film, that is then laminated or permanently adhered to plate 14. After loops 18 have been permanently adhered to the PVC, the PVC can be die-cut to form plate 14. As shown in FIG. 6B, fastening plate 14 has a thickness 't' of about 1.5 millimeters and a diameter 'd' of about 45 millimeters.

Figure 7:
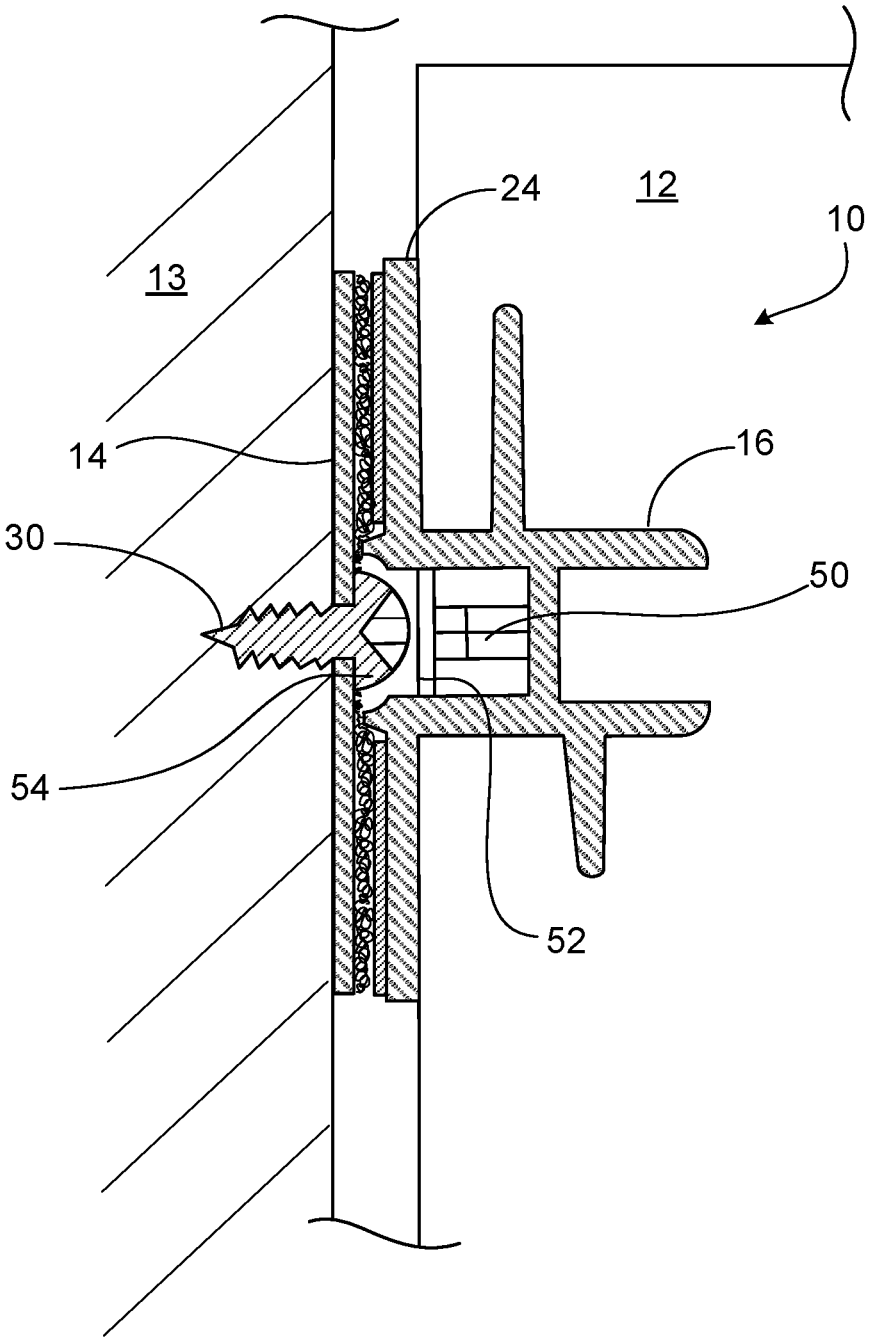
FIG. 7 is a cross-sectional view of an engaged mounting system.

FIG. 7 illustrates a cross-sectional view of an acoustic panel wall mounting system 10 in an engaged position to mount acoustic panel 12 to wall 13. Panel anchor 16 is threaded into panel 12 and plate 14 is fastened to wall 13, together forming a hook-and-loop fastening assembly. Tool receptacle 50 includes a recess 52 configured to accommodate, when the releasable connection is formed, a head 54 of mechanical fastener 30 such as a metal screw holding plate 14 securely to the wall surface.

Figure 8:
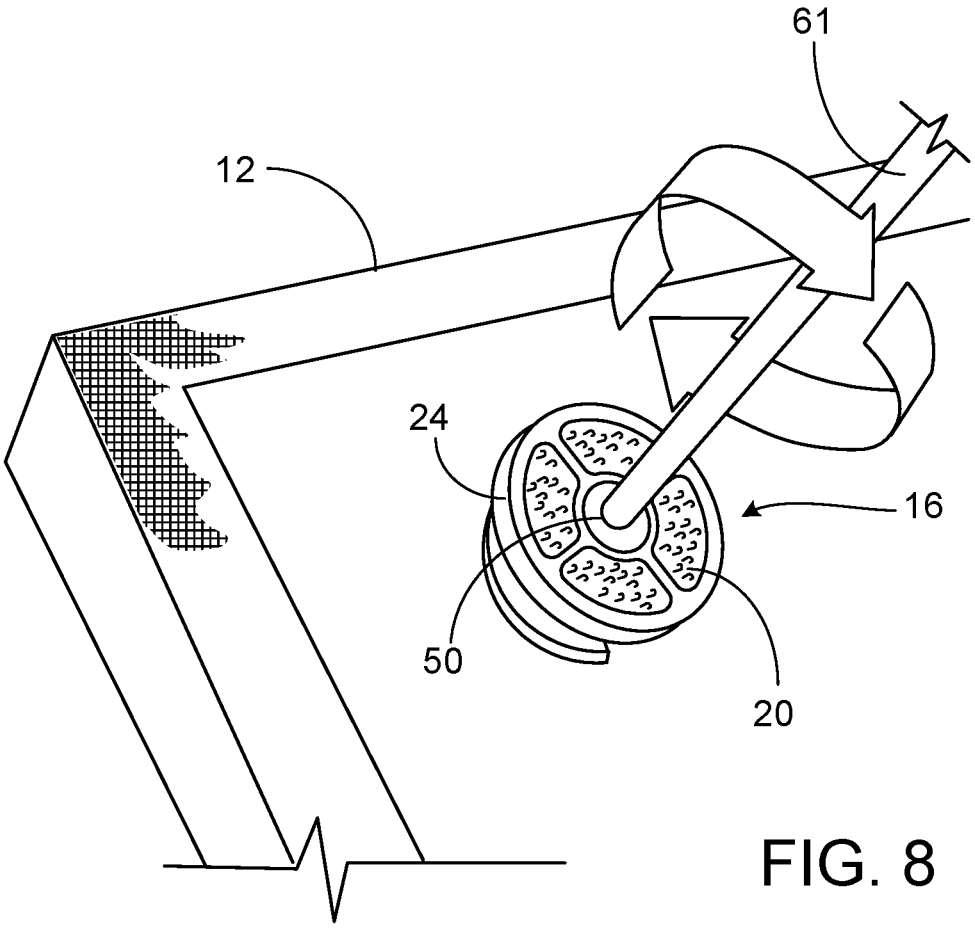
FIGS. 8-16 are sequential, perspective views of a method of mounting an acoustic panel to a wall.
Figure 9:
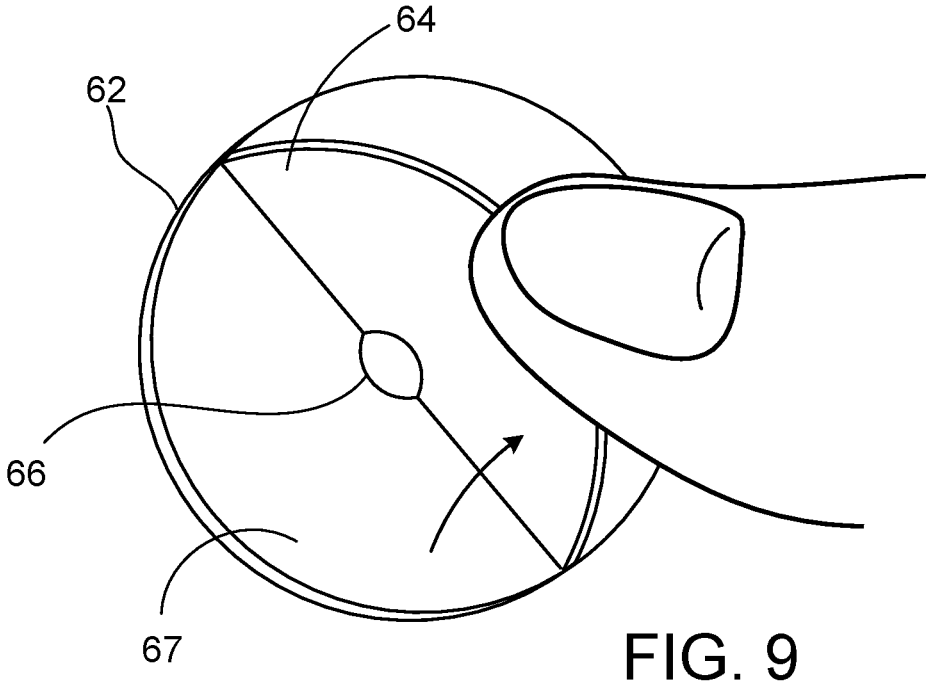
Figure 10:
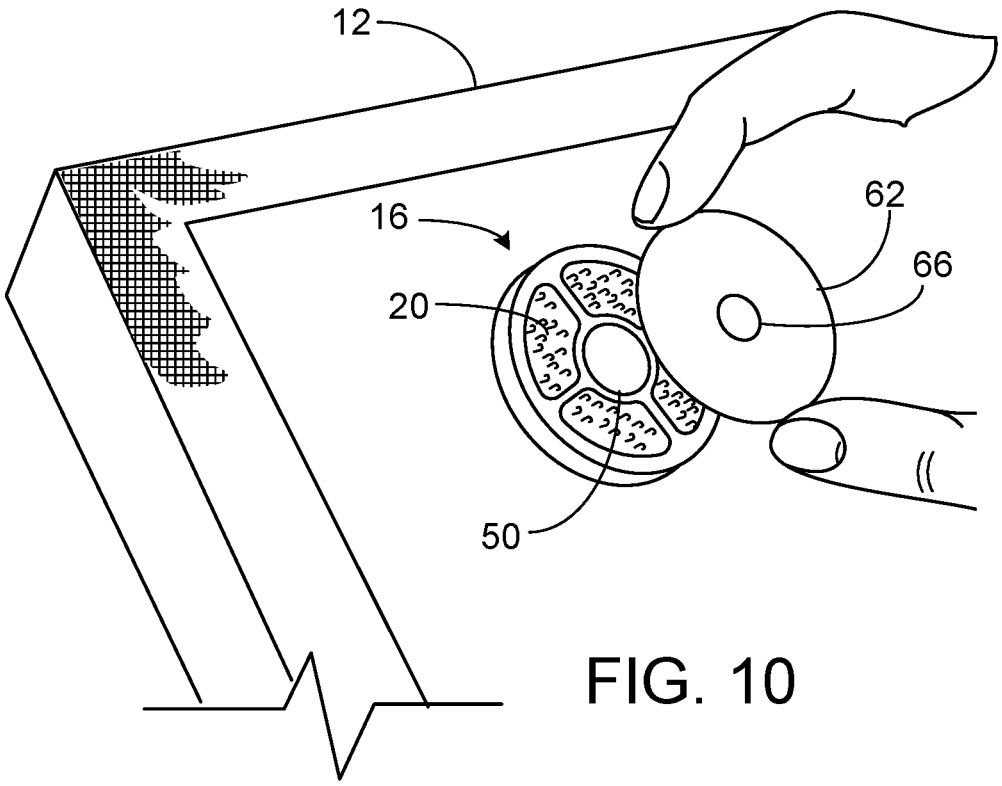
Figure 11:
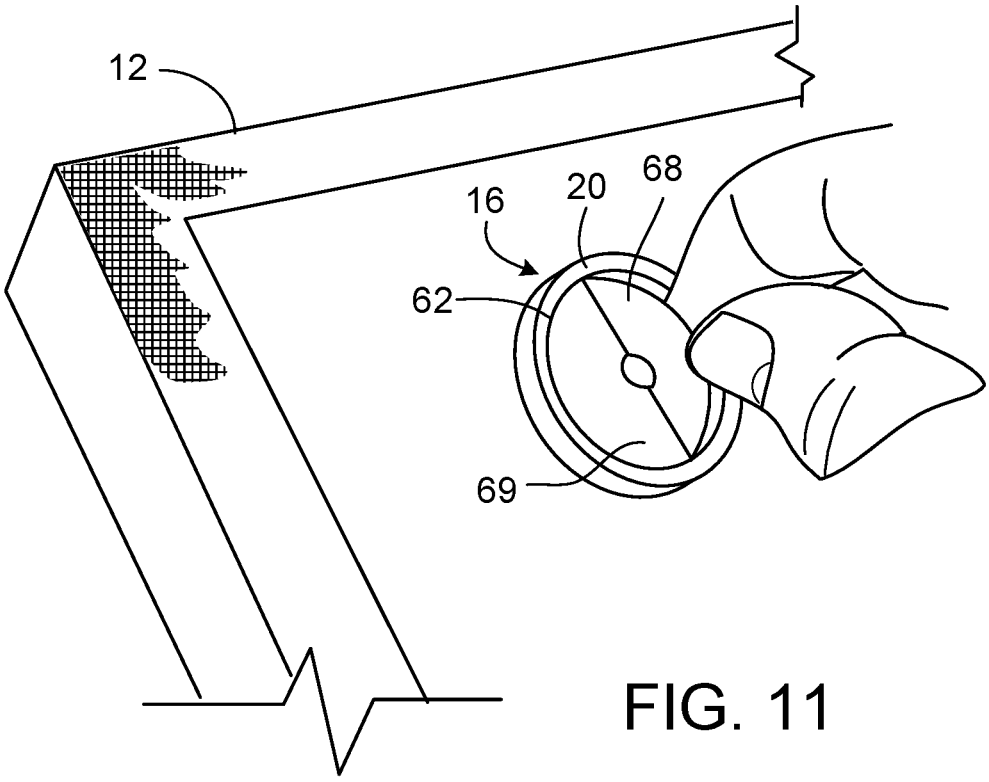

FIGS. 8-16 show a sequence of steps for using acoustic panel wall mounting system 10 to mount an acoustic panel to a wall. Referring to FIG. 8, one or more panel anchors 16 are first threaded into a desired location of a back surface of acoustic panel 12. Anchor 16 is twisted into panel 12 by imparting torque to anchor 16 using a screwdriver 61 inserted in tool receptacle 50. Anchor 15 is threaded into panel 12 until flange 24 is at an outer surface of the panel with the field of fastening hooks 20 being exposed. Then, to attach the loop fastening plates in a corresponding location of the wall, the wall is first marked by using the selected locations of the installed anchor(s) 16. Referring specifically to FIGS. 9-11, a method of marking the wall to which panel 12 is to be mounted, includes using double-sided adhesive patches or stickers 62 to mark the location of anchors 16 in wall 13. Such marking method can be used in several surfaces such as in wood, drywall, masonry, or concrete walls. As shown in FIG. 9, patch 62 is a ring-shaped flexible tape having two release liners on each side. A first release liner 64 is peeled back from patch 62 to expose a first adhesive surface 67. The first adhesive surface 67 of patch 62 is then adhered to the field of fastening hooks 20, as shown in FIG. 10. Patch 62 is adhered to the hooks 20 with a central hole 66 being aligned with receptacle 50. As shown in FIG. 11, after adhering patch 62 to anchor 16, a second release liner 68 is peeled back from a second adhesive surface 69 of patch 62 that is opposite the field of hooks 20.

Figure 12:
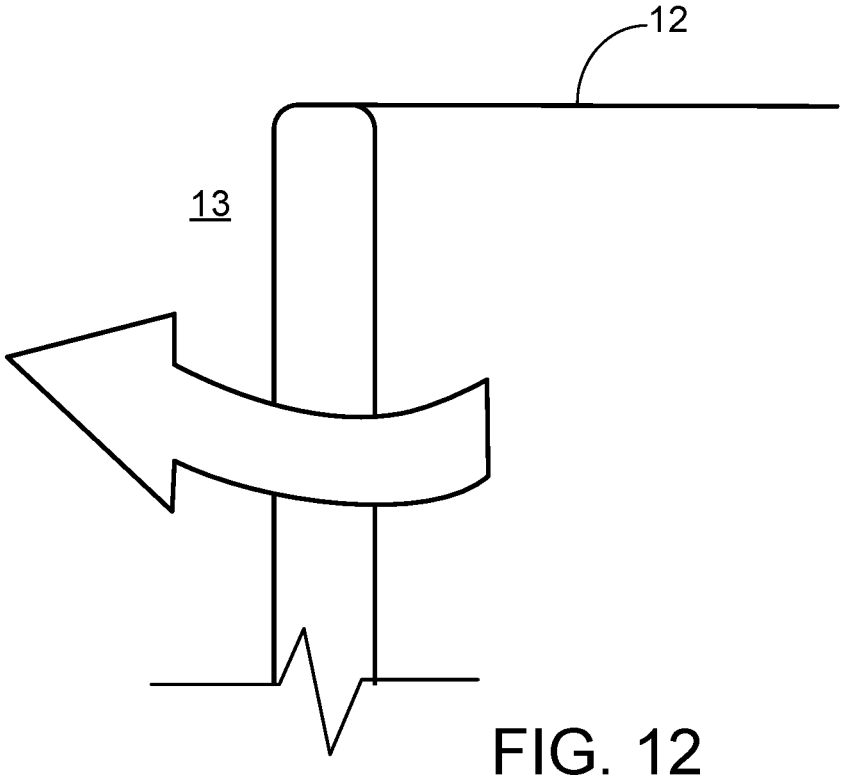
Figure 13:
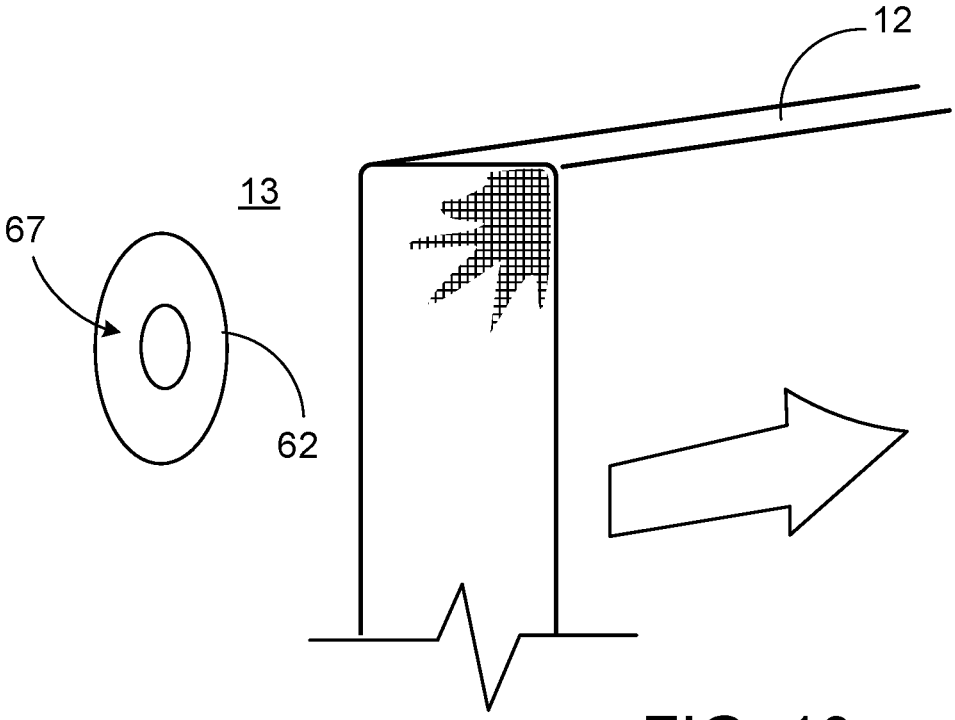

Referring now to FIG. 12, after the flexible patch has been adhered to the anchor, acoustic panel 12 is pressed against wall 13 in a desired mounting position to adhere the second adhesive surface (not shown) of the flexible patch to wall 13. During the installation of a panel that requires two or more anchor-plate fasteners, panel 12 may be firmly pressed against wall 13 at the location of each fastener to ensure proper adhesion of each patch to wall 13. As shown in FIG. 13, panel 12 is moved away from wall 13, leaving flexible patch 62 adhered to wall 13 with the first adhesive surface 67 exposed. In some examples, the second adhesive surface of patch 62 has a higher adhesive force than the first adhesive surface 67, allowing the panel anchor to be quickly released from patch 62 as the patch stays adhered to wall 13.

Figure 14:
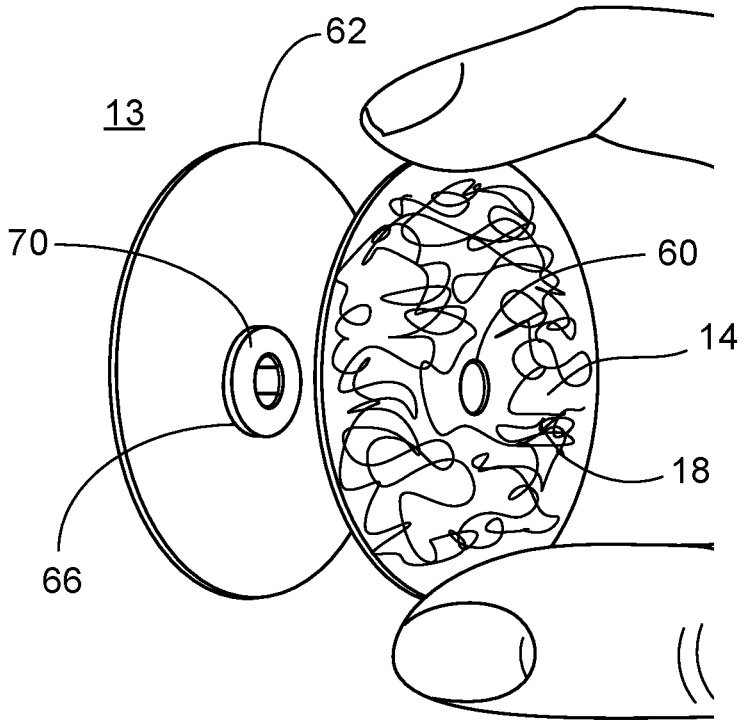
Figure 15:
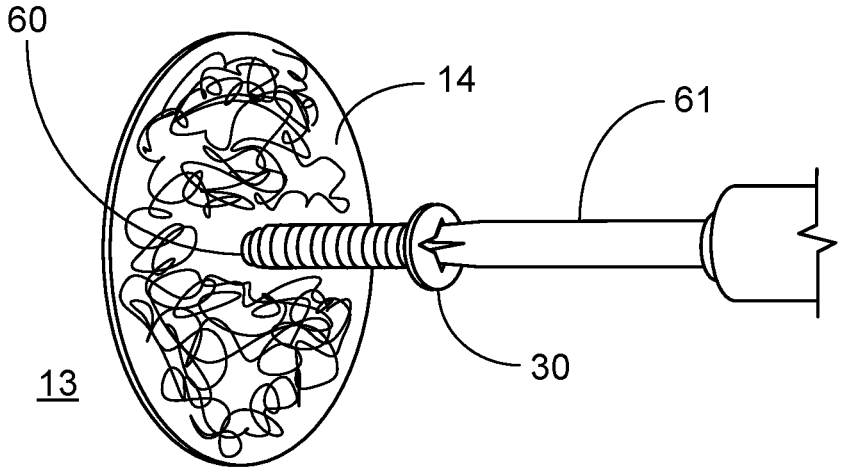

Referring to FIG. 14, with flexible patch 62 adhered at the desired mounting location of wall 13, rigid fastening plate 14 is positioned on the wall over patch 62, with the central hole 66 of patch 62 aligned with central hole 60 of plate 14. Plate 14 is positioned on wall 13 with fastening loops 18 facing away from wall 13. As shown in FIG. 15, after plate 14 is centered with respect to patch 62, plate is attached to wall 13 using a mechanical fastener 30 extending through hole 60. Plate 14 acts as a washer, distributing the load of fastener 30 across an area of wall 13 adjacent plate 14, as a bearing surface of the screw head bears against plate 14. Referring back to FIG. 14, for additional support, before attaching plate 14 to wall 13, a wall anchor 70 (e.g., a hollow anchor or expansion anchor) can be installed in the wall at central hole 66 to increase the weight capacity of fastener 30.

Figure 16:
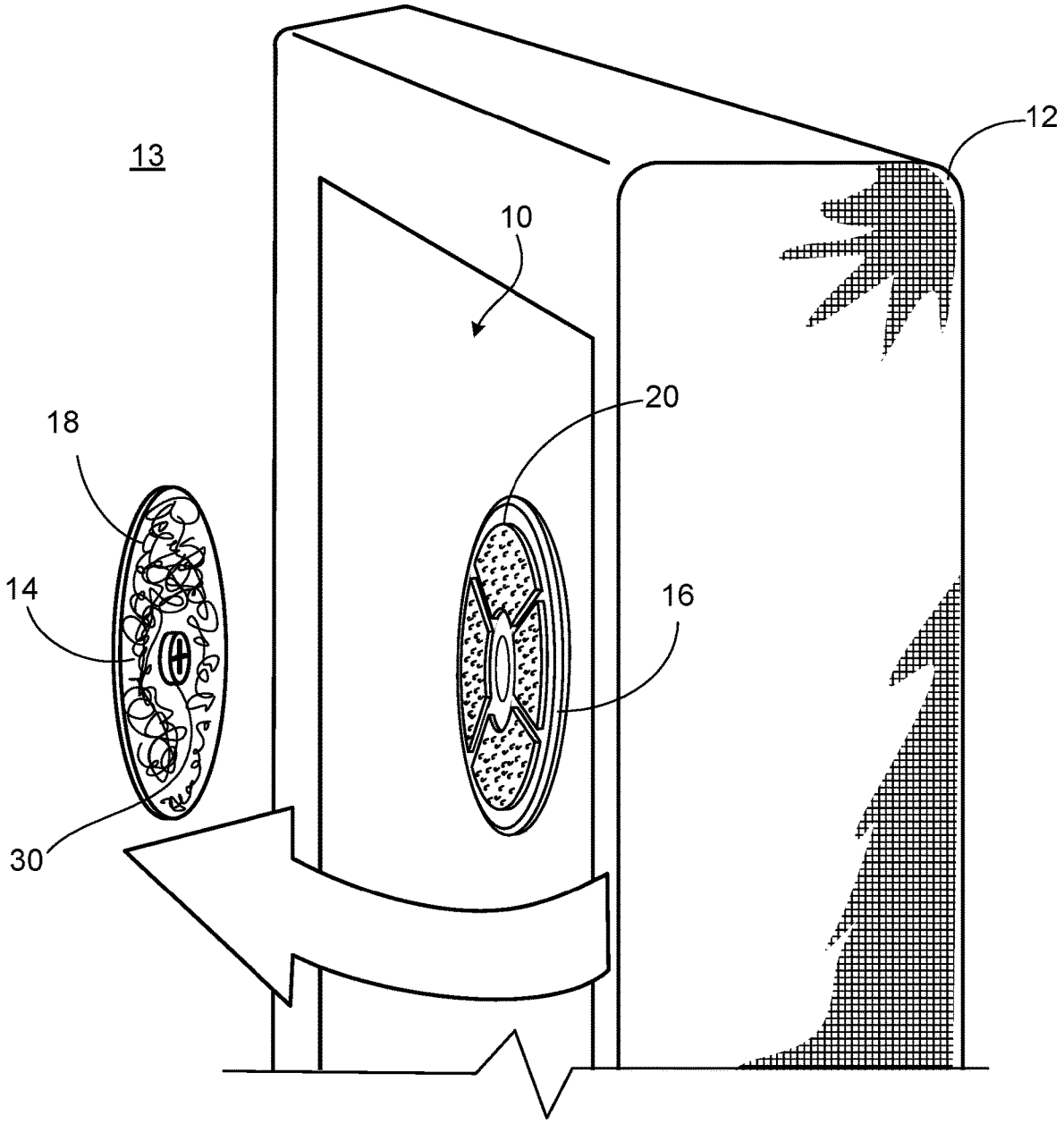

Referring to FIG. 16, with plate 14 secured to wall 13, acoustic board 12 can be mounted to wall 13 by pressing the anchor 16 against plate 14. As anchor 16 is pressed against plate 14, the respective touch fastening features of the anchor and plate are brought into engagement to form a connection to mount panel 12 to wall 13. The mounting system 10 can be connected such that the entire field of hooks 20 is engaged with the entire field of loops 18. However, because the touch fastening elements form a relatively strong connection, even when a portion of the hooks is engaged with a portion of the loops, mounting system 10 can provide enough engagement force to allow panel 12 to be properly mounted. Such feature provides flexibility when panel 12 is being aligned and mounted to wall 13.

Referring back to FIG. 7, the fastening system disclosed herein can be used to mount other objects to a mounting surface, such as thermal insulation boards, wooden frames, etc. For example, anchor 16 can be a metal anchor configured to be threaded into wood, plastic, or metal. Anchor 16 may be, in another example, a rigid plate carrying fastener hooks, fastened to the panel by a separate threaded fastener, such as a metal screw. Additionally, instead of securing an anchor to an object such as a panel, a bounded field of hooks can be adhered to or otherwise secured to the object.

Alternatively, a mountable object can have a bounded field of fastening hooks integrally formed on a surface of the object.

While a number of examples have been described for illustration purposes, the foregoing description is not intended to limit the scope of the invention, which is defined by the scope of the appended claims. There are and will be other examples and modifications within the scope of the following claims.

What is claimed is:

1. An acoustic panel wall mounting system, comprising:

a rigid fastening plate carrying a field of first touch fastening features on one surface thereof, the rigid fastening plate defining an aperture therethrough;

a mechanical fastener configured to extend through the aperture to secure the rigid fastening plate against a wall surface with the field of first touch fastening features exposed and a head of the mechanical fastener extending outward from the rigid fastening plate; and a panel anchor comprising a helix extending from a rigid surface flange carrying a field of second touch fastening features on a surface of the rigid surface flange opposite the helix, the helix comprising a hollow cylinder having an external thread and an open end opposite the rigid surface flange, the panel anchor defining a tool receptacle configured to receive a tool for twisting the helix into a panel until the rigid surface flange is at an outer surface of the panel with the field of second touch fastening features exposed;

wherein the field of first touch fastening features is engageable with the field of second touch fastening features to form a connection when brought into engagement as the panel is placed against the wall surface to contact the rigid fastening plate with the panel anchor; and wherein the tool receptacle defines a recess configured to receive, when the connection between the field of first touch fastening features and the field of second touch fastening features is formed, the head of the mechanical fastener, with the rigid surface flange held parallel to the rigid fastening plate.

2. The acoustic panel wall mounting system of claim 1, wherein the external thread comprises a varying pitch.

3. The acoustic panel wall mounting system of claim 1, wherein the field of second touch fastening features comprises a hook fastening patch permanently affixed to the rigid surface flange.

4. The acoustic panel wall mounting system of claim 1, wherein the field of second touch fastening features comprises discrete hooks molded directly on the surface of the rigid surface flange.

5. The acoustic panel wall mounting system of claim 1, wherein the rigid fastening plate comprises a die-cut plate from extruded PVC.

6. The acoustic panel wall mounting system of claim 1, wherein one of the field of first touch fastening features and the field of second touch fastening features comprises an engageable fibrous surface, and the other of the field of first touch fastening features and the field of second touch fastening features comprises a field of discrete hooks configured to engage the engageable fibrous surface.

7. The acoustic panel wall mounting system of claim 6, wherein the engageable fibrous surface comprises a non-woven material.

8. The acoustic panel wall mounting system of claim 6, wherein the field of discrete hooks has discrete resin stems extending from a common layer of resin.

9. The acoustic panel wall mounting system of claim 1, wherein the field of first touch fastening features and the field of second touch fastening features comprise complementary arrays of hooks arranged to engage when pressed together.

10. The acoustic panel wall mounting system of claim 2, wherein the external thread comprises a first stage defining a first thread pitch, a third stage defining a second thread pitch smaller than the first thread pitch, and a second stage disposed between the first stage and the third stage and defining a constant thread pitch, third stage disposed adjacent the rigid surface flange of the panel anchor.

* * * * *